US005507486A

United States Patent [19]

Miyamoto

[11] Patent Number: 5,507,486

[45] Date of Patent: Apr. 16, 1996

[54] TENNIS RACKET FRAME

[75] Inventor: Kenichi Miyamoto, Akashi, Japan

[73] Assignee: Sumitomo Rubber Industries, Ltd., Hyogo, Japan

[21] Appl. No.: 424,569

[22] Filed: Apr. 17, 1995

Related U.S. Application Data

[63] Continuation of Ser. No. 205,780, Mar. 3, 1994, abandoned, which is a continuation of Ser. No. 957,476, Oct. 7, 1992, abandoned.

[30] Foreign Application Priority Data

Oct. 7, 1991 [JP] Japan ..... 3-259378

[51] Int. Cl.[6] ..... A63B 49/10

[52] U.S. Cl. ..... 273/73 F; 273/73 G; 273/73 J

[58] Field of Search ..... 273/73 R, 73 C, 273/73 E, 73 F, 73 J, 75, 76

[56] References Cited

U.S. PATENT DOCUMENTS

| | | | |
|---|---|---|---|
| 4,221,382 | 9/1980 | Cooper et al. | 273/73 F |
| 4,291,876 | 9/1981 | Hasegawa | 273/73 F |
| 4,309,473 | 1/1982 | Minamisawa et al. | 273/73 F X |
| 4,324,400 | 4/1982 | Tse | 273/76 |
| 4,399,992 | 8/1983 | Molitor | 273/73 F |
| 4,429,873 | 2/1984 | Van Raemdonck | 273/73 F |
| 4,684,131 | 8/1987 | Mortvedt | 273/DIG. 23 |
| 4,747,598 | 5/1988 | Curtis | 273/73 C |
| 4,891,175 | 1/1990 | Haines | 273/73 C X |
| 5,083,780 | 1/1992 | Walton et al. | 273/DIG. 23 |
| 5,088,735 | 2/1992 | Shigetoh | 273/DIG. 23 |

FOREIGN PATENT DOCUMENTS

| | | | |
|---|---|---|---|
| 0169668 | 1/1986 | European Pat. Off. . | |
| 0212014 | 3/1987 | European Pat. Off. | 273/73 F |
| 0441249 | 8/1991 | European Pat. Off. . | |
| 2594345 | 8/1987 | France | 273/73 F |
| 0050582 | 4/1979 | Japan | 273/DIG. 23 |
| 62-142572 | 6/1987 | Japan . | |
| 1-141678 | 6/1989 | Japan . | |

OTHER PUBLICATIONS

"Ceramic Racket", *Popular Science,* Jun., 1986 p. 56.

"Handle With KEVLAR Aids Racket Control", *The Sporting Goods Dealer,* May, 1981, p. 110.

*Primary Examiner*—William E. Stoll

*Attorney, Agent, or Firm*—Birch, Stewart, Kolasch & Birch

[57] ABSTRACT

A tennis racket frame, made of fiber-reinforced resin, in which the volume percentage of aromatic polyamide fiber and/or all-aromatic polyester fiber of all fiber-reinforcing materials of a throat section, a flake section, and a handle section is 40 or more and smaller than 80, respectively. The sectional configuration of the flake section and that of the handle section are set so that the geometrical moment of inertia of the handle section is greater than that of the flake section.

11 Claims, 9 Drawing Sheets

TENNIS RACKET FRAME

This application is a continuation of application Ser. No. 08/205,780 filed on Mar. 3, 1994, abandoned which is a Rule 62 continuation of Ser. No. 07/957,476 filed on Oct. 7, 1992, now abandoned.

BACKGROUND OF THE INVENTION

1. Field of the Invention

The present invention relates to a tennis racket frame made of fiber-reinforced resin and more particularly to the tennis racket frame which is improved in fiber-reinforcing materials and distribution amount thereof in throat and handle sections thereof and in a sectional configuration thereof so as to improve ball-rebounding performance for hitting a ball and vibration-absorbing performance for giving a pleasant feeling to a player, which are contradictory to each other.

2. Description of Related Art

In recent years, the tennis racket frame is made of fiber-reinforced resin because it gives freedom in designing. Normally, the fiber-reinforced resin is molded into the configuration of the tennis racket frame as follows: A plurality of prepreg sheets laminated one on the other around a core material is placed in the cavity of a mold in the configuration of the tennis racket frame and then heated.

Carbon fiber and glass fiber have been mainly used as the fiber-reinforcing material of the prepreg sheet. But the glass fiber is not shock-resistant and not light and the carbon fiber is not shock-resistant, either.

In order to allow the tennis racket to have a high function, proposals have been made in recent years to use aromatic polyamide fiber or all-aromatic polyester fiber having a high strength and a high elastic modulus as a fiber-reinforcing material in combination with the glass fiber or the carbon fiber.

In order to allow a player to feel pleasant in hitting a tennis ball, it is necessary that the tennis racket has ball-rebounding performance and vibration-absorbing performance and is light so that the player can swing it easily. Further, the tennis racket frame is required to be durable.

The aromatic polyamide fiber and all-aromatic polyester fiber have a high strength and a high elastic modulus and thus shock-resistance and have a superior vibration absorbing performance and are light as described above. Thus, these fibers can be preferably used as fiber-reinforcing materials for allowing the tennis racket to have the above-described benefits. Japanese Patent Laid-Open Publication No. 62-142572 disclosed that the vibration-absorbing effect of the racket frame can be improved by using the aromatic polyamide fiber as the material of an inner fiber layer thereof. Japanese Patent Laid-Open Publication No. 1-141678 disclosed the use of a layer comprising the all-aromatic polyester fiber hardened with resin as an intermediate layer of a shaft of the racket frame at a volume percentage of 3 to 15 in order to improve shock-resistant strength and flexibility thereof.

According to the above-described conventional racket frames made of fiber-reinforced resin comprising the aromatic polyamide fiber or the all-aromatic polyester fiber used as the fiber-reinforcing material, it cannot be said that the feature of the aromatic polyamide fiber or the all-aromatic polyester fiber is effectively utilized to enable the tennis racket to have the above-described advantages.

That is, the shock-absorbing performance of the racket frame and the ball-rebounding performance thereof are contradictory to each other. The aromatic polyamide fiber or the all-aromatic polyester fiber, which have high strength and elastic modulus, used as the material of the all inner layer of the racket frame or the all intermediate layer thereof is capable of improving the shock-absorbing performance while it degrades the ball-rebounding performance.

The ball-rebounding performance is closely related to the rigidity of the racket frame. That is, the ball-rebounding performance can be improved by increasing the rigidity of the throat section including the flake section and the handle section. In other words, if the rigidity of these sections is small, the racket is flexed to a great extent when the ball collides with the racket. As a result, the energy generated by the collision between the ball and the racket cannot be effectively utilized.

On the other hand, if the rigidity of the entire frame is large, the vibration-absorbing performance degrades.

The ball-rebounding performance of the racket frame can be improved and the vibration-absorbing performance thereof is not deteriorated only in case of making large the rigidity of the throat section including the flake section and that of the handle section. It is known that the rigidity of the racket frame is determined by the material composing the racket frame and the sectional configuration thereof.

The greater the rigidity is, the higher the strength is. Accordingly, the strength of the throat section including the flake section and the handle section can be improved by making the rigidity thereof large, namely, by improving the ball-rebounding performance thereof. As a result, the durability of the racket frame can be improved.

SUMMARY OF THE INVENTION

It is an object of the present invention to provide a tennis racket frame, made of fiber-reinforced resin, in which the kind and distribution of fiber-reinforcing materials are improved to increase vibration-absorbing performance and ball-rebounding performance which are contradictory to each other.

It is another object of the present invention to provide a tennis racket frame in which the sectional configuration of throat and handle sections are improved and aromatic polyamide fiber and/or all aromatic polyester fiber which have a high strength and a high elastic modulus are used effectively in the throat and handle section thereof, so as to make the rigidity of the throat and handle sections large. That is, material selected from the group consisting of aromatic polyamide fiber, all aromatic polyester fiber and a combination thereof is used effectively in the throat and handle section.

In accomplishing these and other objects of the present invention, there is provided a tennis racket frame, made of fiber-reinforced resin, in which the volume percentage of aromatic polyamide fiber and/or all-aromatic polyester fiber of all fiber-reinforcing materials of a throat section, a flake section, and a handle section is 40 or more and smaller than 80, respectively.

As the material of the fiber-reinforcing material, carbon fiber and glass fiber are used in combination with aromatic polyamide fiber or all-aromatic polyester fiber.

Epoxy resin is used as matrix resin which impregnates the above fiber-reinforcing materials. Preferably, the ratio of the fiber-reinforcing materials is 40% to 70% and that of matrix resin is 60% to 30%.

The fiber-reinforcing materials are impregnated with the matrix resin in the form of a prepreg and then, prepreg sheets are cut to a required size to laminate them one on the other around a core material. Then, the prepreg sheets laminated around the core material are placed in a mold and heated. In this manner, the prepreg sheets are molded into the configuration of the racket frame.

The volume percentage of the aromatic polyamide fiber and/or the all-aromatic polyester fiber of all the fiber-reinforcing materials of the throat section including the flake section and the handle section is 40 or more and smaller than 80, respectively. Thus, the vibration-absorbing performance of the racket frame can be improved with the ball-rebounding performance of the above-described section maintained. Experiments indicate that the above range of 40 vol % to 80 vol % is preferable.

The sectional configuration of the flake section and that of the handle section are set so that the moment of inertia of area in the handle section is greater than that of the flake section. Therefore, the racket frame has an improved ball-rebounding performance.

More specifically, the thickness (T) (length of X-axis in the ball-hitting direction) and width (w) (length of Y-axis perpendicular to the ball-hitting direction) of the flake section and the handle section are set so that the moment of inertia of area in the handle section is greater than that of the flake section.

According to the above-described construction, the racket frame has an improved vibration-absorbing performance owing to the fact that it comprises the aromatic polyamide fiber and/or the all-aromatic polyester fiber serving as the fiber-reinforcing material and having a high strength and a high elastic modulus. Thus, a player can feel pleasant when the player hits a ball with the racket frame. In order to improve the rigidity of the throat section of the racket frame and that of the handle section thereof, the aromatic polyamide fiber and/or the all-aromatic polyester fiber are contained in all the fiber-reinforcing materials disposed in these sections at the above-described volume percentage and in addition, the sectional configurations of these sections are formed as described above. Accordingly, although the above-described fiber-reinforcing materials having a high elastic modulus is used as the material of the racket frame, it has a favorable ball-rebounding performance.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
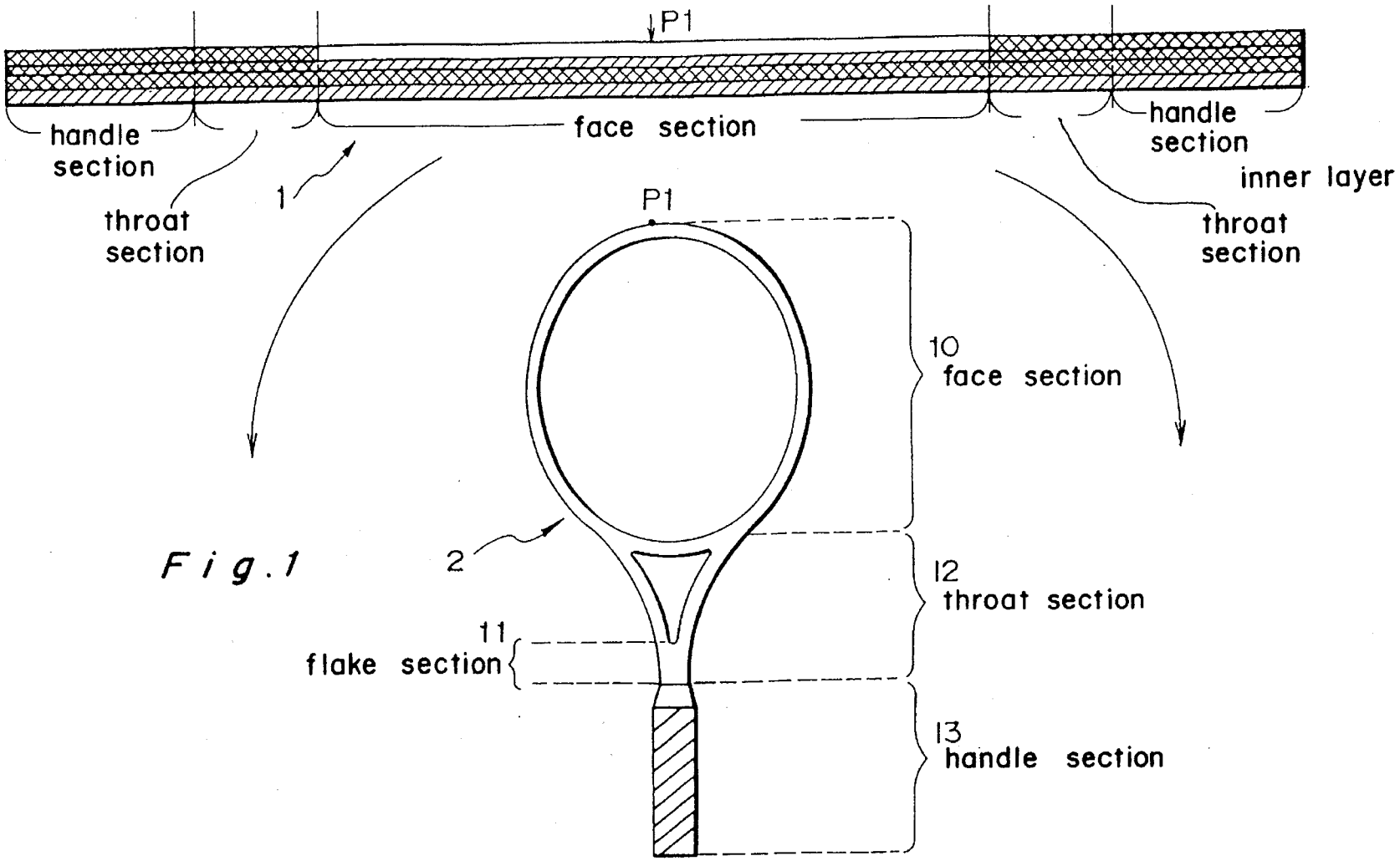
FIG. 1 is a view showing the relationship between fiber-reinforcing materials laminated one on the other and a tennis racket frame formed by molding the fiber-reinforcing materials.

Before the description of the present invention proceeds, it is to be noted that like parts are designated by like reference numerals throughout the accompanying drawings.

A first embodiment of the present invention is described below with reference to FIGS. 1 and 2. FIG. 1 shows the relationship between a laminated fiber 1 preformed by laminating fiber-reinforcing materials impregnated with resin and a tennis racket frame 2, made of fiber-reinforced resin, to be molded by using the laminated fiber 1. The laminated fiber 1 comprising fiber-reinforcing materials laminated one on the other from an inner layer to an outer layer is bent in the direction as shown by arrows to place the laminated fiber 1 in a cavity (not shown) of a mold in the configuration of a tennis racket frame. After the laminated fiber 1 is clamped by the mold, it is heated to form a racket frame 2 comprising a face section 10, a throat section 12 including a flake section 11, and a handle section 13.

Figure 2:
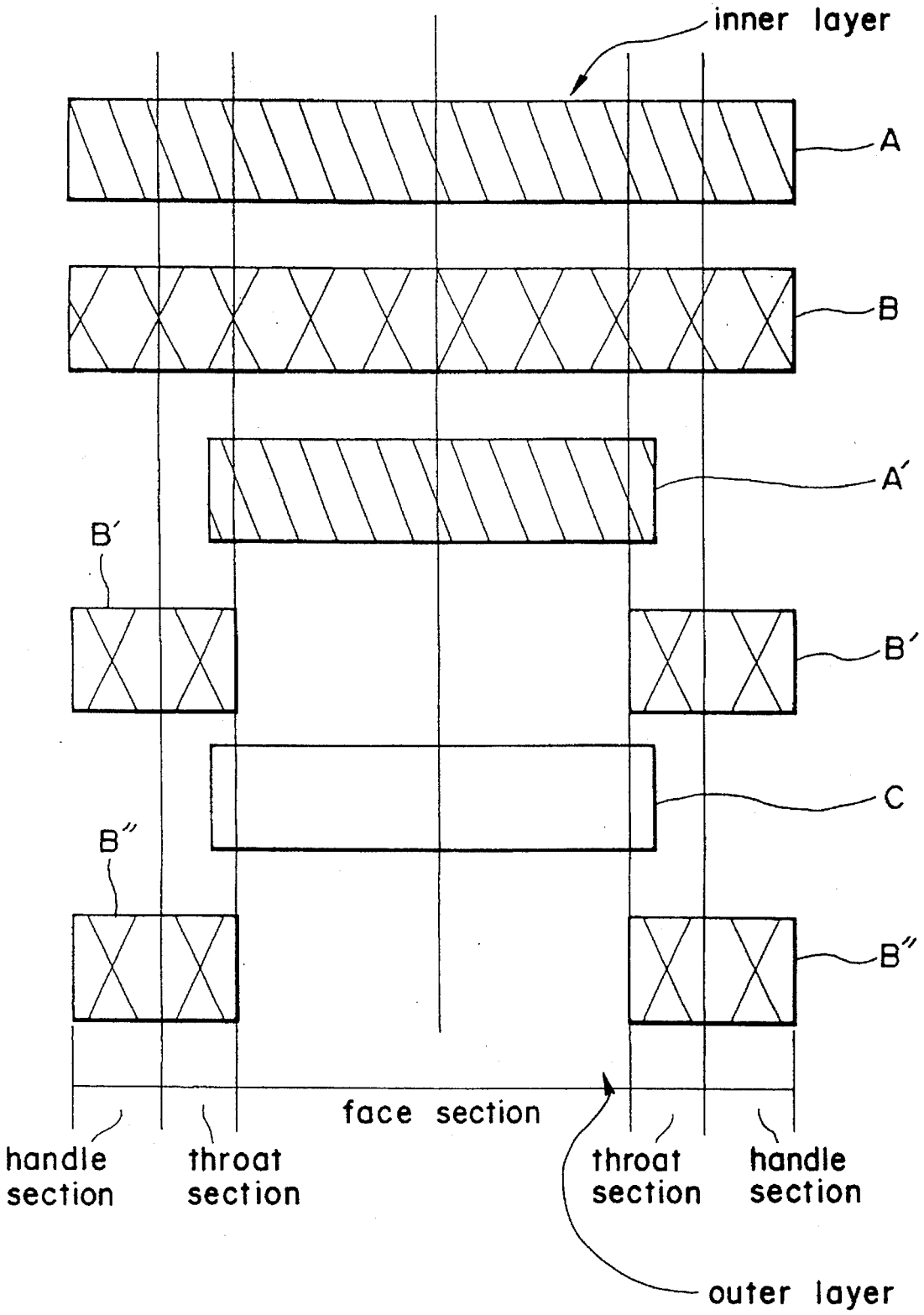
FIG. 2 is a schematic view showing the laminated state of fiber-reinforcing materials according to a first embodiment of the present invention.
Figure 3:
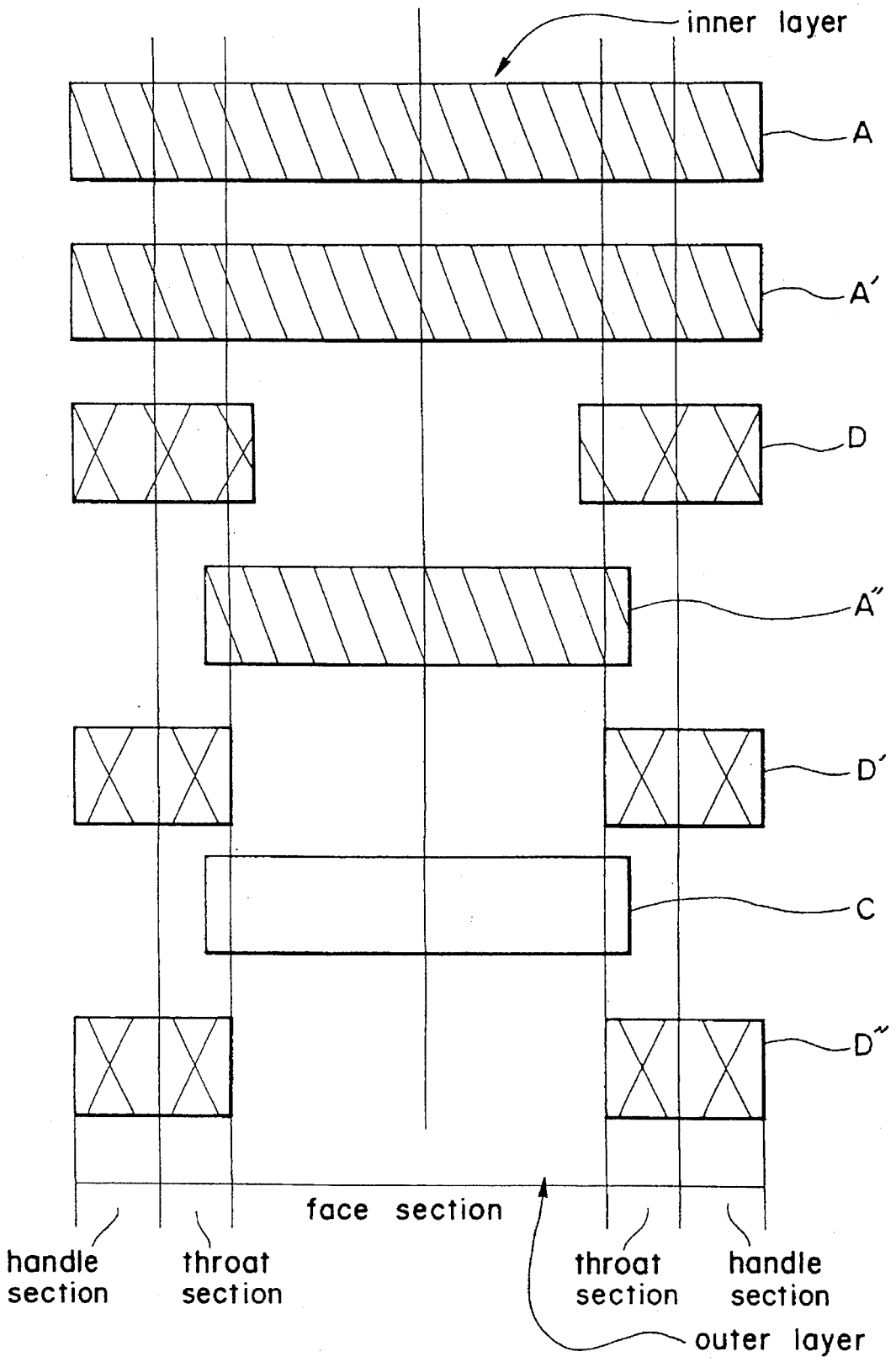
FIG. 3 is a schematic view showing the laminated state of fiber-reinforcing materials according to a second embodiment of the present invention.
Figure 4:
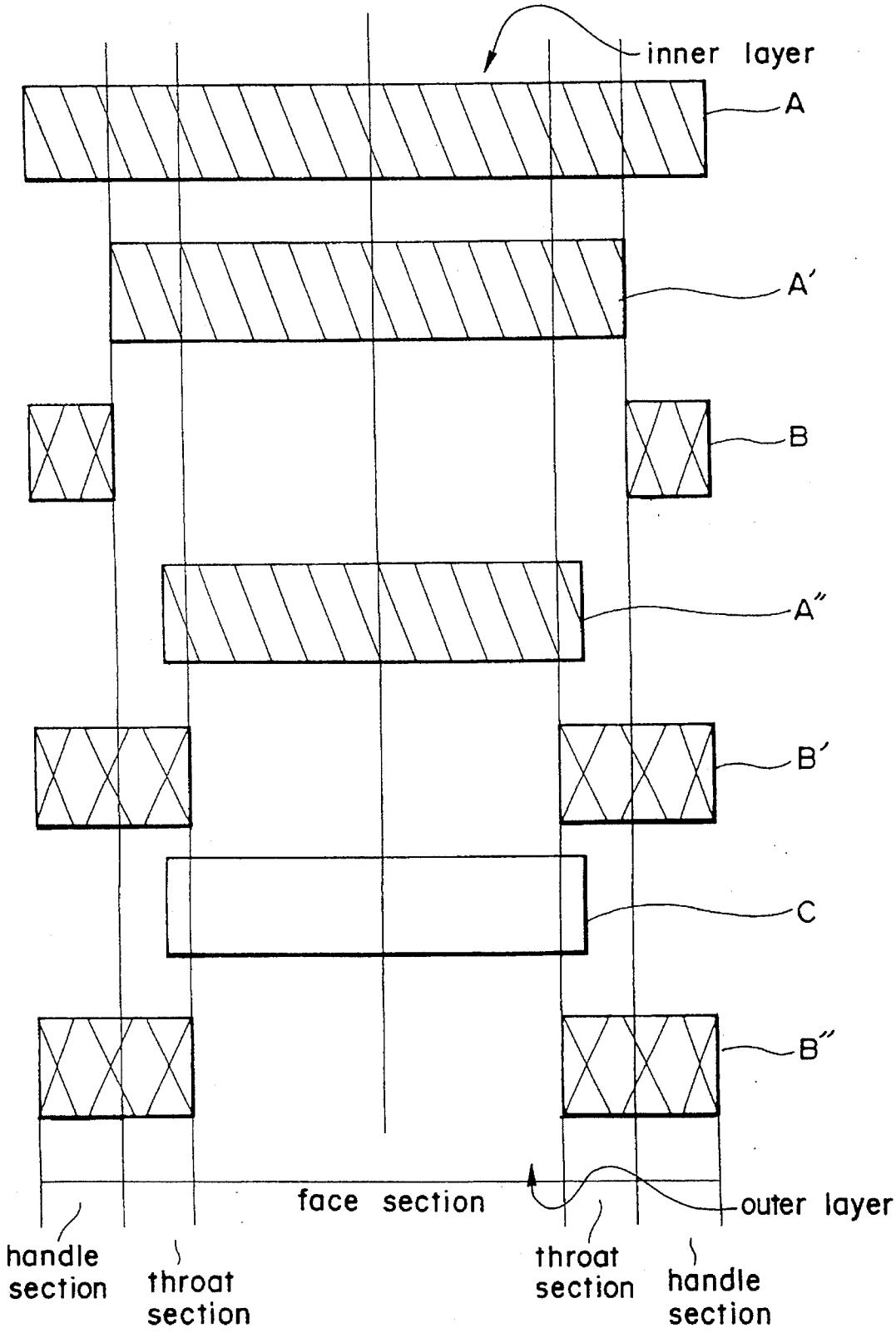
FIG. 4 is a schematic view showing the laminated state of fiber-reinforcing materials according to a third embodiment of the present invention.

The kind of fiber-reinforcing materials composing the laminated fiber 1 and the arrangement thereof are varied from each other in a first embodiment through a third embodiment as shown in FIGS. 2 through 4. But common to the first embodiment through the third embodiment, aromatic polyamide fiber and/or all-aromatic polyester fiber are disposed at a higher percentage in the throat section 12 and the handle section 13 than in the center region of the racket frame, namely, in the face section 10.

In the first embodiment shown in FIG. 2, the fiber-reinforcing materials of the laminated fiber 1 are arranged as follows: the first layer (inner layer) consists of carbon fiber (A) provided on the entire racket frame 2. The second layer consists of aromatic polyamide fiber (B) provided on the entire racket frame 2. The third layer consists of carbon fiber (A') provided in the face section 10. The fourth layer consists of aromatic polyamide fiber (B') provided in the throat section 12 and the handle section 13. The fifth layer consists of glass fiber (C) provided in the face section 10. The sixth layer (outer layer) consists of aromatic polyamide fiber (B") provided in the throat section 12 and the handle section 13.

The carbon fiber (A') of the third layer and the glass fiber (C) of the fifth layer both disposed in the face section 10 overlap in a slight degree with the aromatic polyamide fiber (B') of the fourth layer disposed in the throat section 12 as well as the aromatic polyamide fiber (B") of the sixth layer disposed therein.

In the construction as described above, although the aromatic polyamide fiber is provided on the entire racket frame, namely, the face section 10, the throat section 12, and the handle section 13, the aromatic polyamide fiber is contained at a higher percentage in the fiber-reinforcing materials of the throat section 12 and the handle section 13 than that contained in those of the face section 10. Vectran manufactured by Kurare Co., Ltd is used as the aromatic polyamide fiber.

FIG. 3 shows the kind of fiber-reinforcing materials of the laminated fiber 1 and the distribution thereof according to the second embodiment. The first (inner), second, and fourth layer consist of carbon fiber (A), (A') and (A"), respectively and the third, fifth, and seventh layer consist of all-aromatic polyester fiber (D), (D') and (D"), respectively. The sixth layer consists of glass fiber (C). Kevlar 49 manufactured by Dupon Corp. is used as the allaromatic polyester fiber.

As shown in FIG. 3, in the second embodiment, the all-aromatic polyester fiber is not provided in the face section 10 while it is provided in the throat section 12 and the handle section 13.

FIG. 4 shows the kind of fiber-reinforcing materials of the laminated fiber 1 and the distribution thereof according to the third embodiment. The third embodiment is similar to the second embodiment except that the aromatic polyamide fiber is provided in the third, fifth, and seventh layer instead of the all-aromatic polyester fiber, and that the distribution of the fiber-reinforcing materials is varied from that of the second embodiment. That is, the carbon fiber (A') of the second layer is not provided in the handle section 13 and the aromatic polyamide fiber (B) of the third layer is provided only in the handle section 13. That is, the aromatic polyamide fiber is contained in the fiber-reinforcing materials of the throat section 12 and those of the handle section 13 at a different percentage.

Vectran manufactured by Kurare Co., Ltd is used as the aromatic polyamide fiber, similar to the first embodiment.

Table 1 below shows the volume percentage of the aromatic polyamide fiber (first through third embodiment) and that of the all-aromatic polyester fiber (the second embodiment) contained in the fiber-reinforcing materials of the throat section 12 and the handle section 13. Table 1 also shows the volume percentage of aromatic polyamide fiber or that of all-aromatic polyester fiber contained in the fiber-reinforcing materials of the throat section 12 and the handle section 13 in comparison examples which will be described later.

TABLE 1

| | |
|---|---|
| first embodiment | 75 vol % |
| second embodiment | 60 vol % |
| third embodiment | 40 vol % |
| first cox | 25 vol % |
| second cox | 20 vol % |
| third cox | 0 vol % |

In the above Table, cox is the abbreviation of comparison example.

Epoxy resin manufactured by Dow Chemical Corp. is used in the first through third embodiment as matrix resin which impregnates the fiber-reinforcing materials.

Fiber is contained in the fiber-reinforced resin consisting of the fiber-reinforcing materials and the matrix resin at 40% to 70% in the first through third embodiment.

Figure 5:
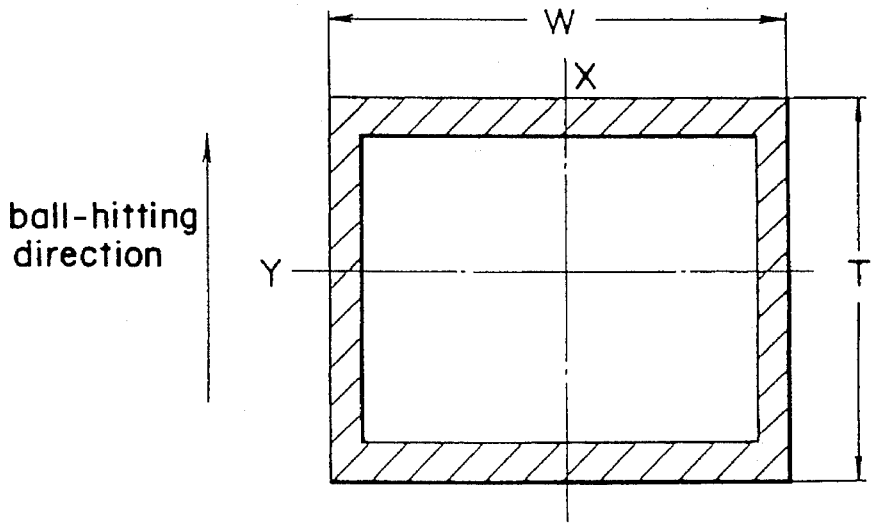
FIG. 5 is a schematic view showing the sectional configuration of a flake section of a racket frame of the present invention.
Figure 6:
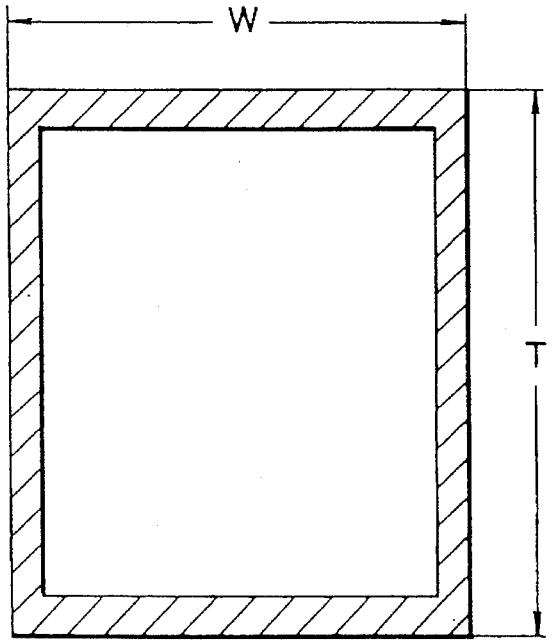
FIG. 6 is a schematic view showing the sectional configuration of a handle section of the racket frame of the present invention.

In the racket frame made of the fiber-reinforced resin according to the first through third embodiment, the sectional configuration of the flake section 11 adjacent to the handle section 13 and that of the handle section 13 are rectangularly hollow as shown in FIGS. 5 and 6, respectively. The thickness (T) (length of X-axis in ball-hitting direction) of the flake section 11 and the handle section 13 and the width (W) (length of Y-axis perpendicular to ball-hitting direction) thereof are set as shown in Table 2 below so that the moment of inertia in the handle section 13 is greater than that of the flake section 11.

Table 2 also shows the size of the flake section and that of the handle section of the racket frame in the comparison example which will be described later.

TABLE 2

| | thickness T (cm) | width W (cm) | Ix $cm^4$ | Iy $cm^4$ |
|---|---|---|---|---|
| flake section (E&C) | 2.10 | 2.70 | 0.65 | 0.97 |
| handle section (E) | 2.60 | 2.40 | 0.98 | 0.87 |
| handle section (C) | 1.80 | 2.30 | 0.40 | 0.59 |

In the above, E denotes embodiments; and C denotes comparison example.

The grip size of the racket frame is normally 100mm to 118mm. Supposing that the thickness of the racket frame is 1.00mm, the above thickness (T) and width (W) are preferable to make the moment of inertia in the handle section 13 greater than that of the flake section 11.

Preferably, the width (W) of the handle section 13 ranges from 2.90cm to 2.00cm; the thickness (T) thereof ranges from 3.00cm to 1.80 cm; Iy of the moment of inertia ranges from 1.50 to 0.42 $cm^4$; and Ix thereof ranges from 1.59 to 0.36 $cm^4$.

Experiment

Tennis racket frames of the above-described construction and those of different constructions from the present invention were prepared to measure their vibration-absorbing performance, flexibility amount (rigidity), ball-rebounding performance, and strength.

Figure 7:
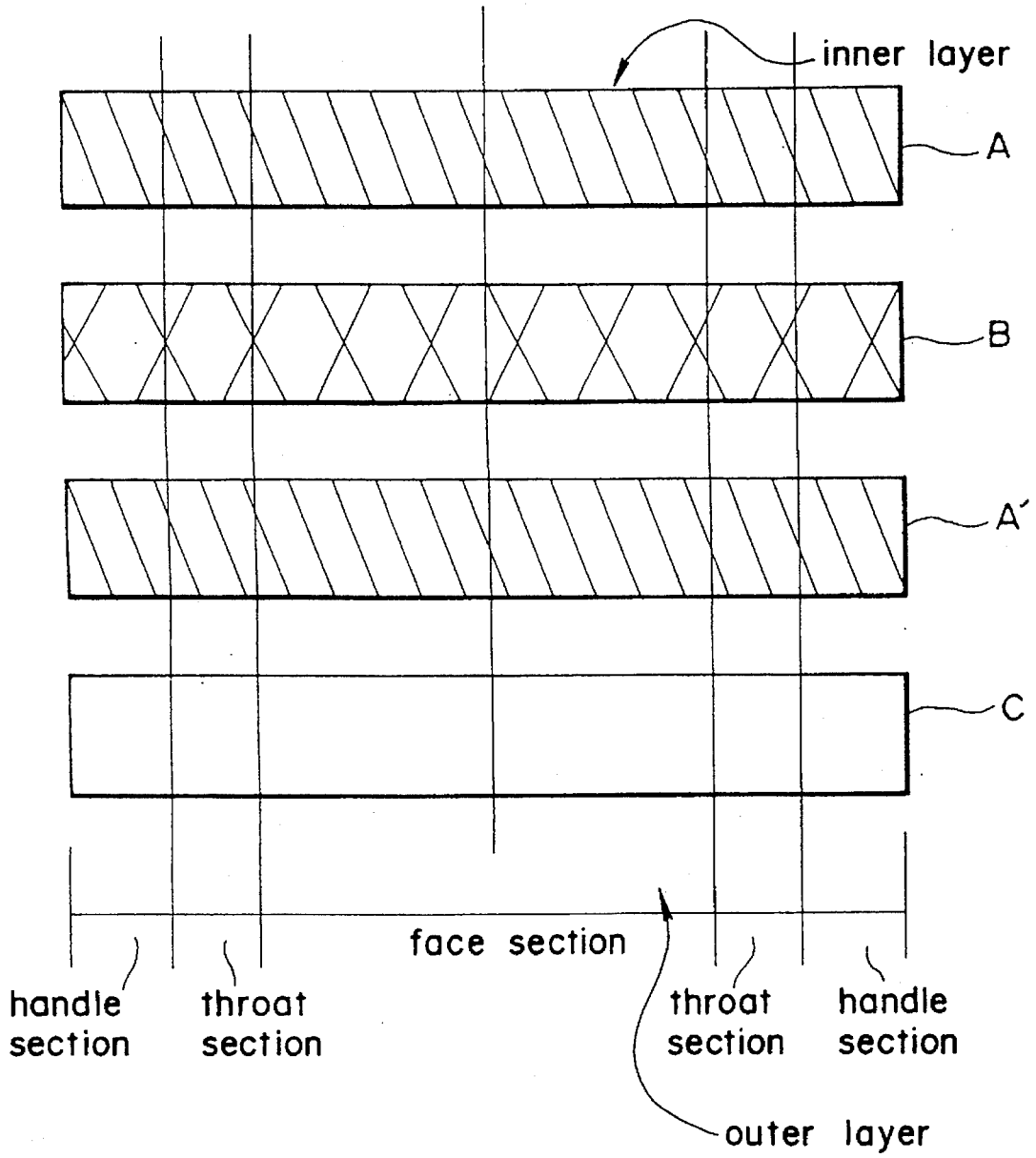
FIG. 7 is a schematic view showing the laminated state of fiber-reinforcing materials according to a first comparison example.
Figure 8:
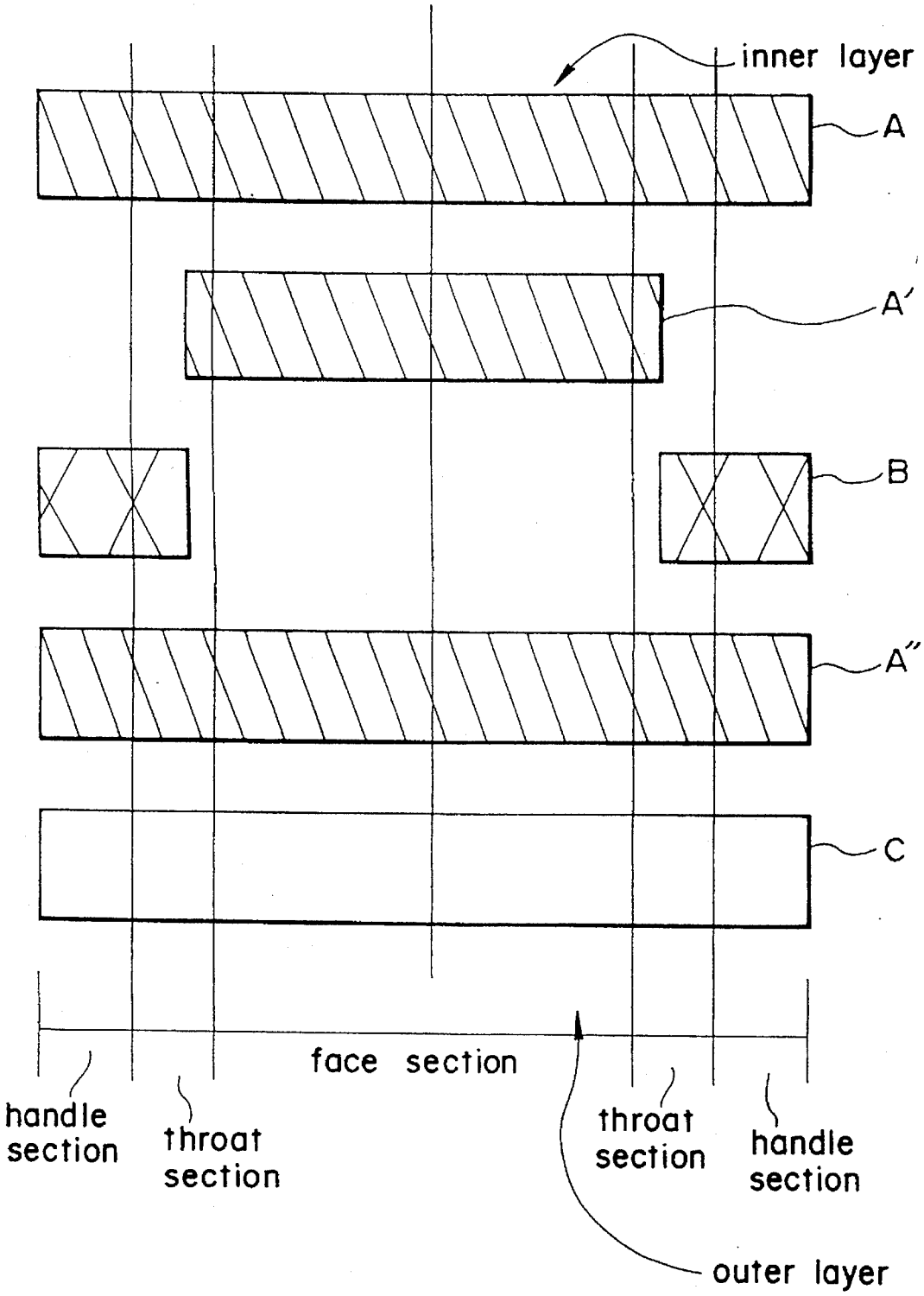
FIG. 8 is a schematic view showing the laminated state of fiber-reinforcing materials according to a second comparison example.
Figure 9:
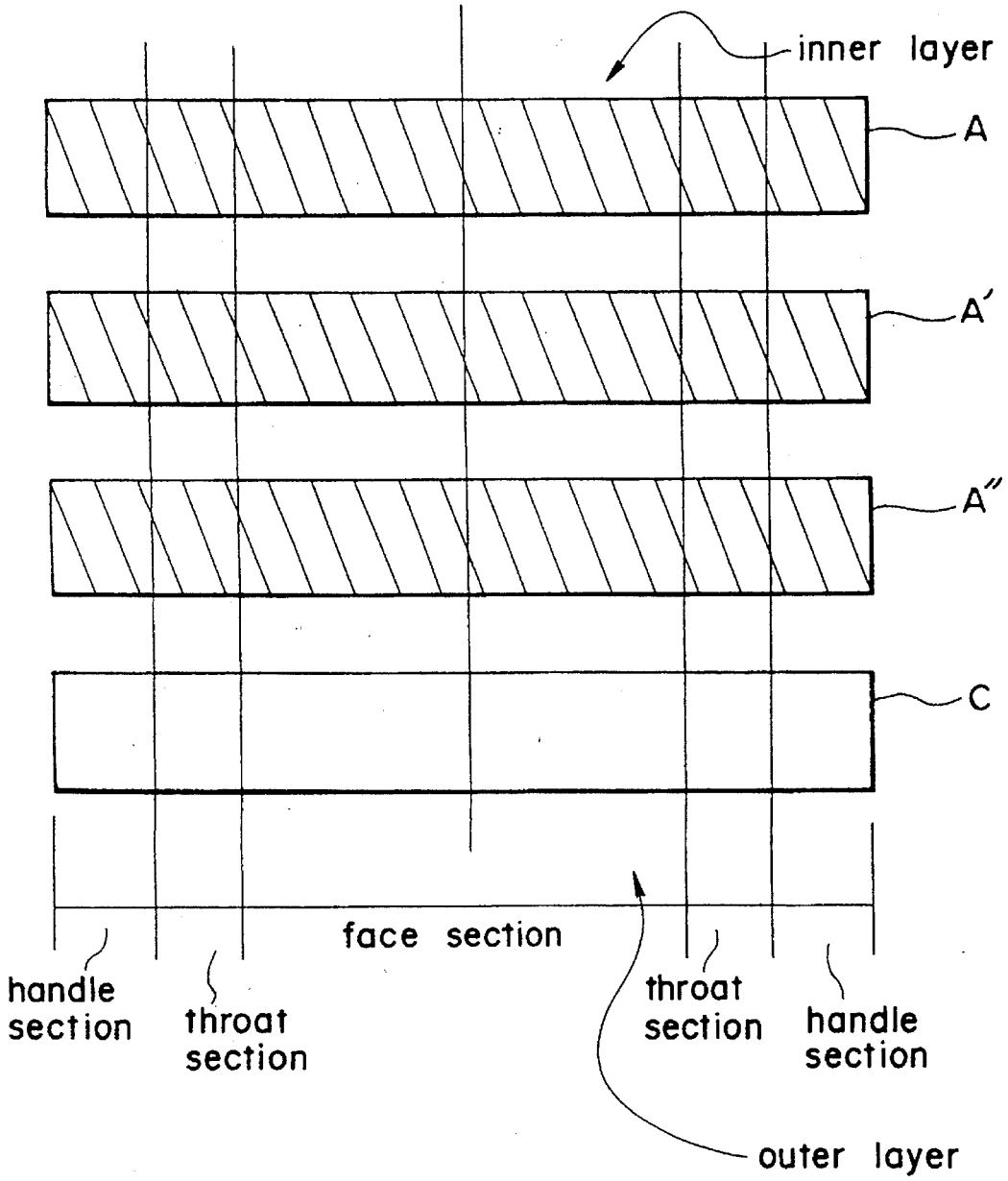
FIG. 9 is a schematic view showing the laminated state of fiber-reinforcing materials according to a third comparison example.

As experimental examples, racket frames having the construction according to the first through third embodiment and those of the first through third comparison example having fibers laminated one on the other as shown in FIGS. 7 through 9 were manufactured.

Epoxy resin was used as a matrix resin which impregnated the fiber-reinforcing materials of all example racket frames while the kind of the fiber-reinforcing materials and the distribution thereof were varied in each of the embodiments and comparison examples. All racket frames were equal to each other in the configuration of the ball-hitting section, the total length thereof, and tensile strength of strings thereof.

The fiber-reinforcing materials of the racket frame of the first comparison example are laminated one on the other as shown in FIG. 7. In the entire racket frame, namely, in both sides of the handle section 13, both sides of the throat section 12, and the face section 10, the first layer (inner layer) consists of carbon fiber (A); the second layer consists of aromatic polyamide fiber (B); the third layer consists of carbon fiber (A'); and the fourth layer (outer layer) consists of glass fiber (C).

The fiber-reinforcing materials of the racket frame of the second comparison example are laminated one on the other as shown in FIG. 8. The first layer (inner layer) consists of carbon fiber (A) provided on the entire racket frame 2; the second layer consists of carbon fiber (A') disposed in the face section 10; the third layer consists of all-aromatic polyester fiber (D) provided in the throat section 12 and the handle section 13; the fourth layer consists of carbon fiber (A") provided on the entire racket frame 2; and the fifth layer consists of glass fiber (C) provided on the entire racket frame 2.

The fiber-reinforcing materials of the racket frame of the third comparison example are laminated one on the other as shown in FIG. 9. The first (inner layer), second, and third layers consist of carbon fibers (A), (A') and (A"), respectively provided on the entire racket frame; and the fourth layer (outer layer) consists of glass fiber (C) provided on the entire racket frame 2.

The aromatic polyamide fiber or the all-aromatic polyester fiber is contained at a volume percentage as shown in Table 1 in the fiber-reinforcing materials of the throat section 12 and the handle section 13 of each of the first through third comparison examples.

The racket frames of the first through third comparison examples are identical to each other in the configurations thereof and identical to the configuration of the racket frames of the first through third embodiments except for the handle section 13. The sectional configuration of the handle section 13 of the racket frame according to each of the first through third comparison examples is rectangularly hollow similar to the sectional configuration of the handle section 13 of the racket frame according to the first embodiment as shown in FIG. 6. But as shown in Table 2, the thickness (T), width (W) of the handle section 13, the geometrical moment of inertia Ix and Iy of the flake section 11 and those of the handle section 13 of the comparison examples are different from those of the first through third embodiments. That is, the moment of inertia in the flake section 11 is greater than that of the handle section 13.

Figure 10:
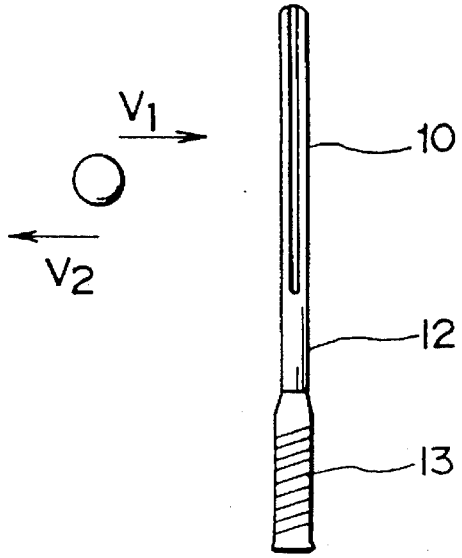
FIG. 10 is a schematic view for describing the coefficient of restitution of a racket frame.

Restitution coefficients were measured by striking a tennis ball against the center of the ball-hitting surface of each racket frame which was kept to be vertical as shown in FIG. 10. Supposing that the velocity of the ball measured before it collided with the strung racket frame is V1 and the velocity of the ball measured after it was hit by the racket frame was V2, each restitution coefficient is expressed as V2/V1. The same ball was used in the test.

Figure 11:
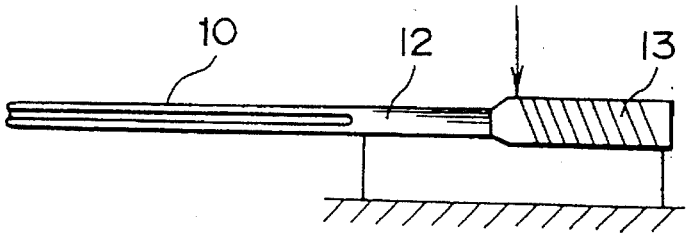
FIG. 11 is a schematic view showing a method for examining the strength of the racket frame.

As shown in FIG. 11, in order to measure the strength of each racket frame, each racket frame was horizontally supported at the left end of the throat section 12 and a point in the vicinity of the right end (grip end) of the handle section 13, and the same load was applied to each racket frame downward at the center point between the two supporting points by means of a pressure-applying instrument not shown.

In order to measure the rigidity of each racket frame which was kept vertical, the flexibility amount thereof was measured by applying a load thereto downward at the upper end of the head thereof with the grip end thereof stationary. The smaller the flexibility amount was, the greater was the rigidity.

An acceleration pick-up was used to measure the vibration-absorbing performance of each racket frame by applying vibrations to each racket frame. The vibration-absorbing coefficient (%)=(amplitude at the grip measured 0.2 seconds after the ball was hit by the racket/amplitude measured at the grip at the time when the ball was hit)×100. The smaller the vibration-absorbing coefficient is, the superior more the vibration-absorbing performance is.

Table 3 shows the vibration-absorbing performance, flexibility amount (rigidity), restitution coefficient, and strength of the racket frame according to the first through third embodiments and the first through third comparison examples.

TABLE 3

| | vibration (%) | flexibility (mm) | restitution | strength (kgf) |
|---|---|---|---|---|
| E1 | 21.3 | 13.7 | 0.428 | 243 |
| E2 | 24.5 | 13.7 | 0.432 | 245 |
| E3 | 25.8 | 12.9 | 0.433 | 260 |
| C1 | 32.3 | 14.0 | 0.415 | 235 |
| C2 | 35.6 | 14.0 | 0.417 | 238 |
| C3 | 53.1 | 13.7 | 0.420 | 243 |

In the above, E1 denotes first embodiment; E2 denotes second embodiment; E3 denotes third embodiment; C1 denotes first comparison example; C2 denotes second comparison example; C3 denotes third comparison example; vibration means vibration-absorbing performance; flexibility means flexibility amount; and restitution means restitution coefficient.

As apparent from Table 3, in the racket frame according to the first through third embodiment, the aromatic polyamide fiber or the all-aromatic polyester fiber is contained in the fiber-reinforcing materials of the throat section and the handle section at a higher percentage than in the face section. Thus, the racket frame according to the present invention has a high vibration-absorbing performance.

The aromatic polyamide fiber or the all-aromatic polyester fiber having a high elastic modulus is contained in the fiber-reinforcing materials of the racket frame of the first through third embodiments at a higher percentage than in those of the racket frame of the first through third comparison examples. But the flexibility amount of the racket frame according to the embodiments is smaller than those of the first through third comparison examples and thus the rigidity of the former is larger than that of the latter because in the former, the moment of inertia of the handle section is greater than that of the flake section thereof.

The rigidity of the throat section and that of the handle section greatly related with the restitution coefficient is greater in the first through third embodiments than in the first through third comparison examples. Therefore, the restitution coefficient of the racket frame according to the first through third embodiments is greater than that of the first through third comparison examples. That is, the racket frame according to the present invention is capable of hitting a ball a long distance.

The aromatic polyamide fiber or the all-aromatic polyester fiber having a high strength is contained at a higher percentage in the fiber-reinforcing materials of the first through third embodiments than in those of the first through third comparison examples. Thus, the racket frame of the former has a higher strength than that of the latter.

According to the above-described experimental result, when the volume percentage of the aromatic polyamide fiber and/or the all-aromatic polyester fiber having a high strength and a high elastic modulus of all the fiber-reinforcing materials is smaller than 40 or greater than 80 in the throat section, the flake section, and the handle section, the racket frame has low vibration-absorbing performance and strength.

As apparent from the foregoing description, in the racket frame according to the present invention, aromatic polyamide fiber and/or all-aromatic polyester fiber having a high strength and a high elastic modulus effectively are contained in the fiber-reinforcing material at a higher volume percentage in the throat section and the handle section than in the face section. In addition, the throat section and the handle section have an improved configuration. Thus, the racket frame has an improved ball-rebounding performance and vibration-absorbing performance which are contradictory to each other.

That is, a player can feel pleasant when he has hit a ball with vibration-damping performance increased in the racket frame and without damaging the ball-rebounding performance thereof. Further, according to the present invention, the aromatic polyamide fiber and/or the all-aromatic polyester fiber are contained in the fiber-reinforcing material at a higher volume percentage than in the conventional racket frame. Thus, the racket frame is light and has a high strength. That is, the racket frame according to the present invention is favorable in various performances.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A tennis racket frame which is comprising:

a face section;

a throat section including a V-shaped section and a flake section; and a handle section, said frame being made of fiber-reinforced resin, wherein a volume percentage of a reinforcing material selected from the group consisting of aromatic polyamide fiber, all-aromatic polyester fiber and a combination thereof of said throat section and said handle section is 40 or more and smaller than 75, respectively and, wherein the sectional configuration of the flake section of said throat section and that of said handle section are set so that a moment of inertia of said handle section is greater than that of the flake section, wherein said frame includes an inner layer of carbon fiber which extends through each of said handle section, said throat section and said face section, and at least two layers of said reinforcing material which extend only through said handle section and said throat section.

2. The tennis racket frame according to claim 1, wherein a Y-direction is perpendicular to a ball striking direction and an X-direction is parallel to a ball striking direction of the tennis racket frame and wherein Iy of a moment of inertia of the handle ranges from 1.50 to 0.42 $cm^4$ , and Ix thereof ranges from 1.59 to 0.36$cm^4$ .

3. The tennis racket frame according to claim 1, further including a second layer of carbon fiber and a layer of glass fiber which both extend only through said face section and a portion of said throat section.

4. The tennis racket frame according to claim 1, further including a layer of said reinforcing material extending through each of said handle section, said throat section and said face section.

5. A tennis racket frame comprising:

a face section;

a throat section including a V-shaped section and a flake section; and a handle section, said frame being made of fiber-reinforced resin wherein a volume percentage of a reinforcing material selected from the group consisting of aromatic polyamide fiber, aromatic polyester fiber and a combination of aromatic polyamide fiber and aromatic polyester fiber of said throat section and said handle section is greater than a volume percentage thereof in said face section;

said frame including an inner layer of carbon fiber which extends through each of said handle section, said throat section and said face section, and at least two layers of said reinforcing material which extend only through said handle section and said throat section.

6. The tennis racket frame according to claim 5, wherein a sectional configuration of the flake section of said throat section and that of said handle section are set so that a moment of inertia of said handle section is greater than that of the flake section.

7. The tennis racket frame according to claim 6, wherein a thickness of the flake section is less than a width of the flake section, said thickness being measured in a ball-hitting direction and said width being measured perpendicular to the ball-hitting direction and transverse to a longitudinal axis of said frame.

8. The tennis racket frame according to claim 5, wherein a thickness of said handle section is greater than a width of said handle section, said thickness being measured in a ball-hitting direction and said width being measured perpendicular to the ball-hitting direction and transverse to a longitudinal axis of said frame.

9. The tennis racket frame according to claim 4, wherein a Y-direction is perpendicular and an X-direction is parallel to a ball striking direction of the tennis racket frame and wherein Iy of a moment of inertia of the handle ranges from 1.50 to 0.42 $cm^4$ and Ix thereof ranges from 1.59 to 0.36 $cm^4$.

10. The tennis racket frame according to claim 5, further including a second layer of carbon fiber and a layer of glass fiber which both extend only through said face section and a portion of said throat section.

11. The tennis racket frame according to claim 5, further including a layer of said reinforcing material extending through each of said handle section, said throat section and said face section.

* * * * *